US011615912B2

(12) United States Patent
Chou

(10) Patent No.: US 11,615,912 B2
(45) Date of Patent: Mar. 28, 2023

(54) TRANSFORMER WITHOUT MATCHING SLEEVE FOR WIRE WINDING OPERATION

(71) Applicant: INNOTRANS TECHNOLOGY CO., LTD., New Taipei (TW)

(72) Inventor: Tsung-Han Chou, Keelung (TW)

(73) Assignee: INNOTRANS TECHNOLOGY CO., LTD., New Taipei (TW)

( * ) Notice: Subject to any disclaimer, the term of this patent is extended or adjusted under 35 U.S.C. 154(b) by 412 days.

(21) Appl. No.: 16/999,807

(22) Filed: Aug. 21, 2020

(65) Prior Publication Data

US 2021/0090790 A1 Mar. 25, 2021

(30) Foreign Application Priority Data

Sep. 25, 2019 (TW) ..... 108134638

(51) Int. Cl.
*H01F 27/30* (2006.01)
*H01F 27/28* (2006.01)

(52) U.S. Cl.
CPC ..... *H01F 27/30* (2013.01); *H01F 27/2823* (2013.01)

(58) Field of Classification Search
CPC ..... H01F 27/30; H01F 27/2823; H01F 27/325
USPC ..... 336/222, 198
See application file for complete search history.

(56) References Cited

U.S. PATENT DOCUMENTS 6,480,085 B2 * 11/2002 Chiang ..... H01F 5/02 336/208
9,899,139 B2 * 2/2018 Li ..... H01F 5/04
10,559,416 B2 * 2/2020 Luk ..... H01F 27/24
2011/0193673 A1 * 8/2011 Tsai ..... H01F 27/29 336/84 M
2015/0194257 A1 * 7/2015 Chen ..... H01F 27/325 336/222
2016/0233021 A1 * 8/2016 Ma ..... H01F 27/29
2016/0336111 A1 * 11/2016 Li ..... H01F 5/04
2018/0137968 A1 * 5/2018 Luk ..... H01F 27/292

FOREIGN PATENT DOCUMENTS

CN 101908411 B 10/2012
CN 203760282 U 8/2014
TW M505046 7/2015

* cited by examiner

*Primary Examiner* — Elvin G Enad
*Assistant Examiner* — Joselito S. Baisa
(74) *Attorney, Agent, or Firm* — Muncy, Geissler, Olds & Lowe, P.C.

(57) ABSTRACT

A transformer without matching sleeve for wire winding operation comprises a transformer wire frame, an iron core, a first winding unit and a second winding unit. The transformer wire frame comprises a winding part, a first wire outlet part and a second wire outlet part. The winding part comprises a first baffle, the second wire outlet part comprises a first inclined surface, a first partition plate, and a first block, the first partition plate divides the second wire outlet part into a first winding area and a second winding area, the first partition plate is only arranged corresponding to the first winding area. The first block is positioned in the first winding area to divide the first winding area into an initial winding area and a series winding area. Therefore, when the second winding is wound, the isolation requirement can be met without matching a sleeve.

9 Claims, 5 Drawing Sheets

TRANSFORMER WITHOUT MATCHING SLEEVE FOR WIRE WINDING OPERATION

FIELD OF THE INVENTION

The invention relates to a transformer structure, in particular to a transformer structure which meets the isolation requirement without threading a sleeve during winding.

BACKGROUND OF THE INVENTION

At present, the primary side or the secondary side of the transformer is not only implemented by a single winding but by a plurality of windings, so that when the transformer with the plurality of windings on a single side is used for leading out wires, an isolation sleeve is sleeved at a tail end of each winding to avoid wrong contact between the windings.

However, this method leads to the fact that in the development of transformers, the isolation sleeves need to be manually installed at the ends of each winding and cannot be implemented mechanically and automatically.

Furthermore, although CN 203760282U proposes a technical solution aiming at solving the afore mentioned problems, the wire frame disclosed in the patent is only partially isolated from the wire outlet part, and cannot be used in the case where a plurality of sub-windings connected in series exist in a single-sided winding.

In addition to the foregoing, there are other patents disclosing structures for isolating wires, such as those disclosed in TW M505046 and CN 101908411B, which do not address a specific isolation solution in the case of a plurality of sub-windings connected in series in a single-sided winding.

SUMMARY OF THE INVENTION

The main purpose of the invention is to solve the problem that the conventional transformer is not provided with a winding isolation structure, so that the conventional transformer needs to be matched with a sleeve for implementation during winding.

In order to achieve the object, the invention provides a transformer without matching sleeve for wire winding operation comprising: a transformer wire frame comprising a winding part, a first wire outlet part connected with one side of the winding part, and a second wire outlet part connected with the other side of the winding part which is not provided with the first wire outlet part, wherein the winding part is provided with a first baffle close to the second wire outlet part, and the second wire outlet part is provided with a first inclined surface facing the winding part, a first partition plate arranged on the first inclined surface, and a first block arranged opposite to the first baffle and a wire channel is defined by the first block together with the first baffle, the first partition plate divides the second wire outlet part into a first winding area and a second winding area, the first baffle is only arranged corresponding to the first winding area, the first block is positioned in the first winding area to divide the first winding area into an initial winding area close to the second winding area and a series winding area in an opposite direction from the second winding area; an iron core arranged on the transformer wire frame; a first winding unit is arranged on the winding part and a line of the first winding unit penetrates through the first wire outlet part; and a second winding unit comprises a first winding segment, a second winding segment and a third winding segment, wherein the first winding segment enters from the initial winding area and winds on the winding part through the wire channel, the second winding segment is connected with the first winding segment and enters the series winding area, and the third winding segment is connected with the second winding segment, and a line of the third winding segment penetrates into the series winding area without contacting with the wire channel to wind around the winding part, and then protrude from the second winding area.

In one embodiment, the second wire outlet part is provided with a first wiring trough which is arranged on the first inclined surface opposite to the winding area.

In one embodiment, the winding part includes a second block connected with the first partition plate, the second block including a connection portion connected to the first partition plate and a nose portion which extends from the connection portion and protrudes toward the second winding area.

In one embodiment, a thickness of the second block is increased from the nose portion toward the connection portion.

In one embodiment, the winding part includes a central axis, one side of the first baffle facing the central axis includes a first distance with the central axis, and one side of the second block facing the central axis includes a second distance with the central axis.

In one embodiment, the second wire outlet part includes two first retaining walls located on two sides of the first inclined surface, and one of the two first retaining walls located within the first winding area and the first block together define a wire channel passing through the series winding area.

In one embodiment, the second wire outlet part include a plurality of wire posts respectively arranged in the initial winding area, the series winding area and the second winding area.

Through the implementation of the invention, compared with the conventional application, the invention includes the following characteristics: according to the transformer wire frame disclosed by the invention, when the second winding is wound, a sleeve is not needed to isolate a wire segment which generates contact, so that the process of mounting the sleeve is subtracted, and the winding can be carried out mechanically and automatically.

DETAILED DESCRIPTION OF THE PREFERRED EMBODIMENTS

Figure 1:
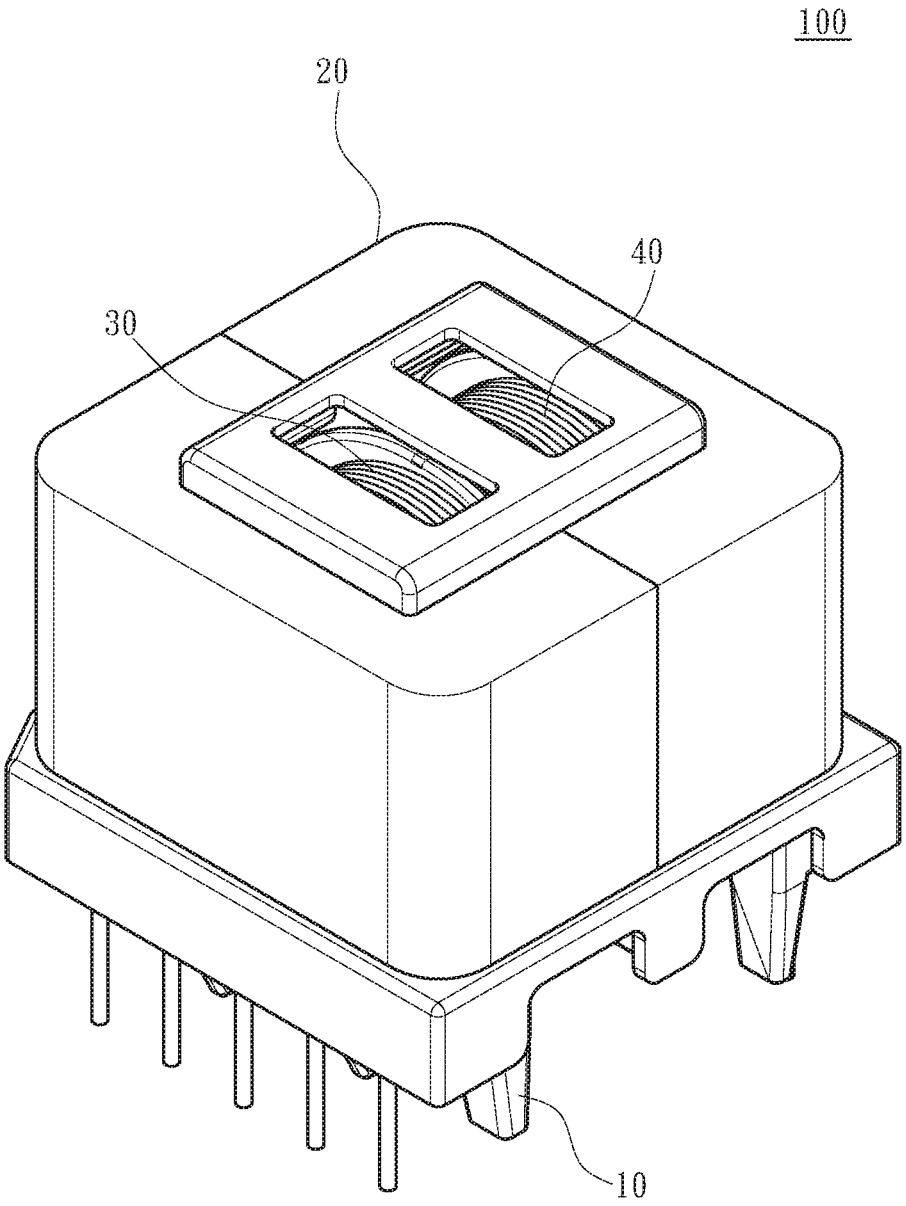
FIG. 1 is a structural schematic diagram of an embodiment of the present invention.
Figure 2:
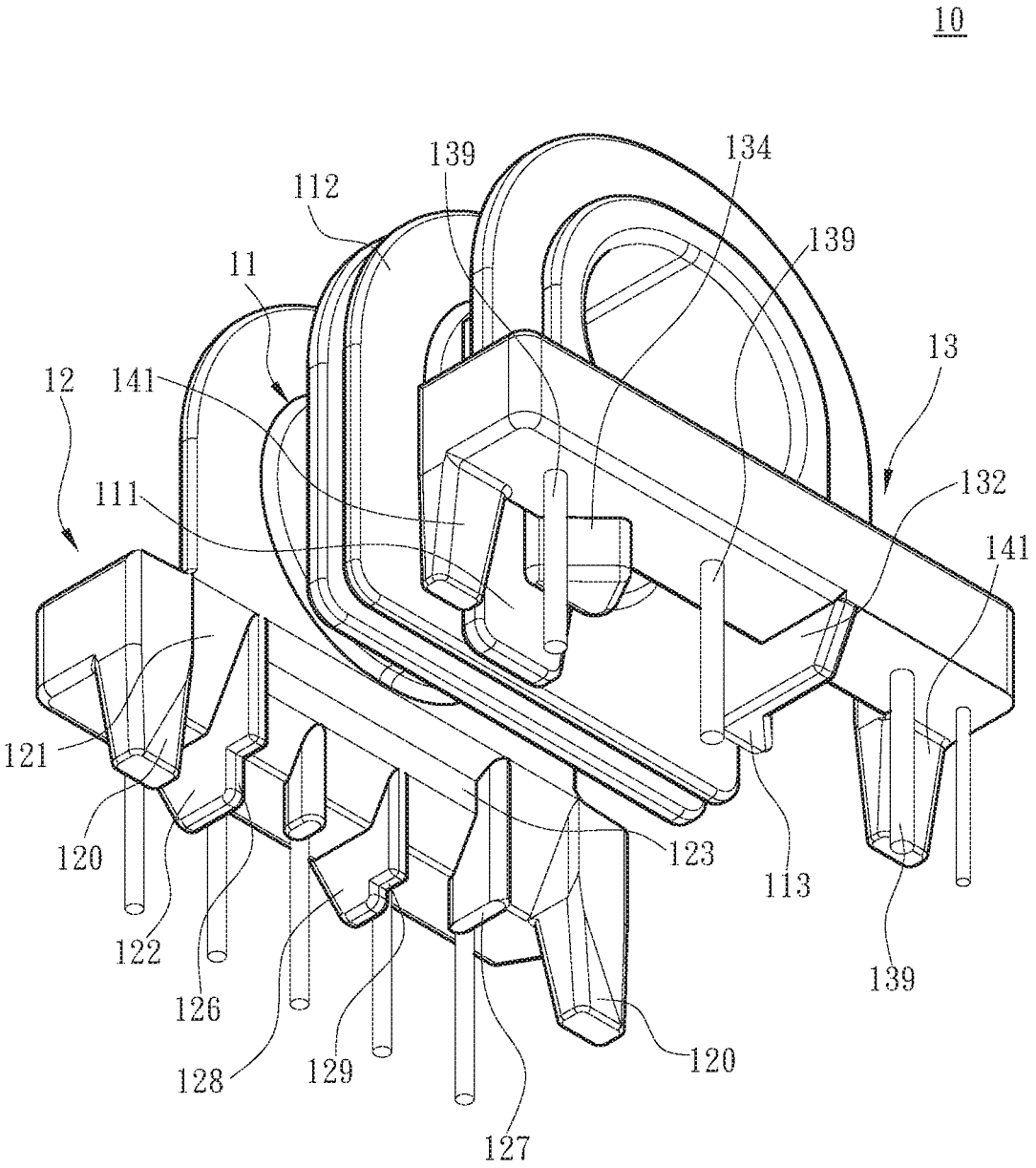
FIG. 2 is a structural schematic diagram of a transformer wire frame of an embodiment of the present invention.
Figure 3:
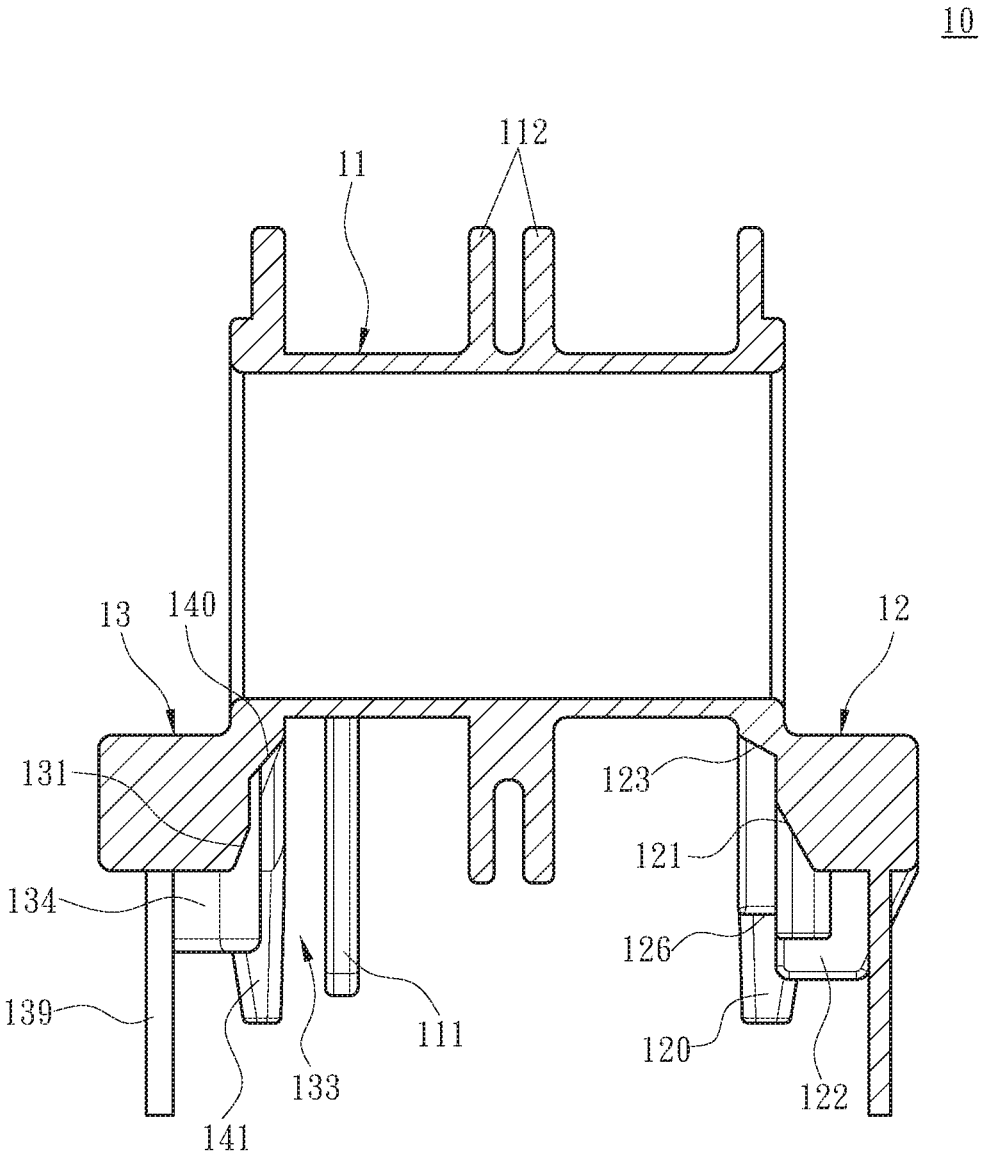
FIG. 3 is a cross-sectional structural schematic diagram of a transformer wire frame of an embodiment of the present invention.

The terms "first", "second", and the like, when used in connection with elements of the invention, are intended to distinguish one structure from another and are not intended to be limiting in any way whatsoever. The detailed description and technical contents of the present invention will now be described with reference to the drawings as follows:

Referring to FIG. 1, FIG. 2, FIG. 3 and FIG. 4, the present invention provides a transformer 100 for performing winding without matching sleeve, which may be vertical or horizontal rather than limit to the horizontal as shown in the drawing of the present invention. The transformer 100 includes a transformer wire frame 10, an iron core 20 mounted on the transformer wire frame 10, a first winding unit 30, and a second winding unit 40. The transformer wire frame 10 comprises a winding part 11, a first wire outlet part 12 connected to one side of the winding part 11, and a second wire outlet part 13 connected to the other side of the winding part 11 which is not provided with the first wire outlet part 12. Further, the winding part 11 includes a substantially tubular structure so as to provide a portion of the iron core 20 therein. The winding part 11 includes a first baffle 111 close to the second wire outlet part 13 and at least a second baffle 112 distinguishing a winding area of the first winding unit 30 and the second winding unit 40. The first baffle 111 is different from the second baffle 112, the second baffle 112 is designed to surround the winding part 11, the first baffle 111 is only provided on a portion of the winding part 11 without surrounding the winding part 11. Further, the second wire outlet part 13 includes a first inclined surface 131 facing the winding part 11, a first partition plate 132 provided on the first inclined surface 131, and a first block 134 provided opposite to the first baffle 111 and a wire channel 133 is defined by the first block 134 together with the first baffle 111. Further, the first partition plate 132 divides the second wire outlet part 13 into a first winding area 135 and a second winding area 136, and the first baffle 111 is only provided corresponding to the first winding area 135. The first block 134 is located in the first winding area 135 to divide the first winding area 135 into an initial winding area 137 close to the second winding area 136 and a series winding area 138 in an opposite direction from the second winding area 136. Further, the second wire outlet part 13 includes a plurality of poles 139 provided in the initial winding area 137, the series winding area 138, and the second winding area 136, respectively.

Figure 5:
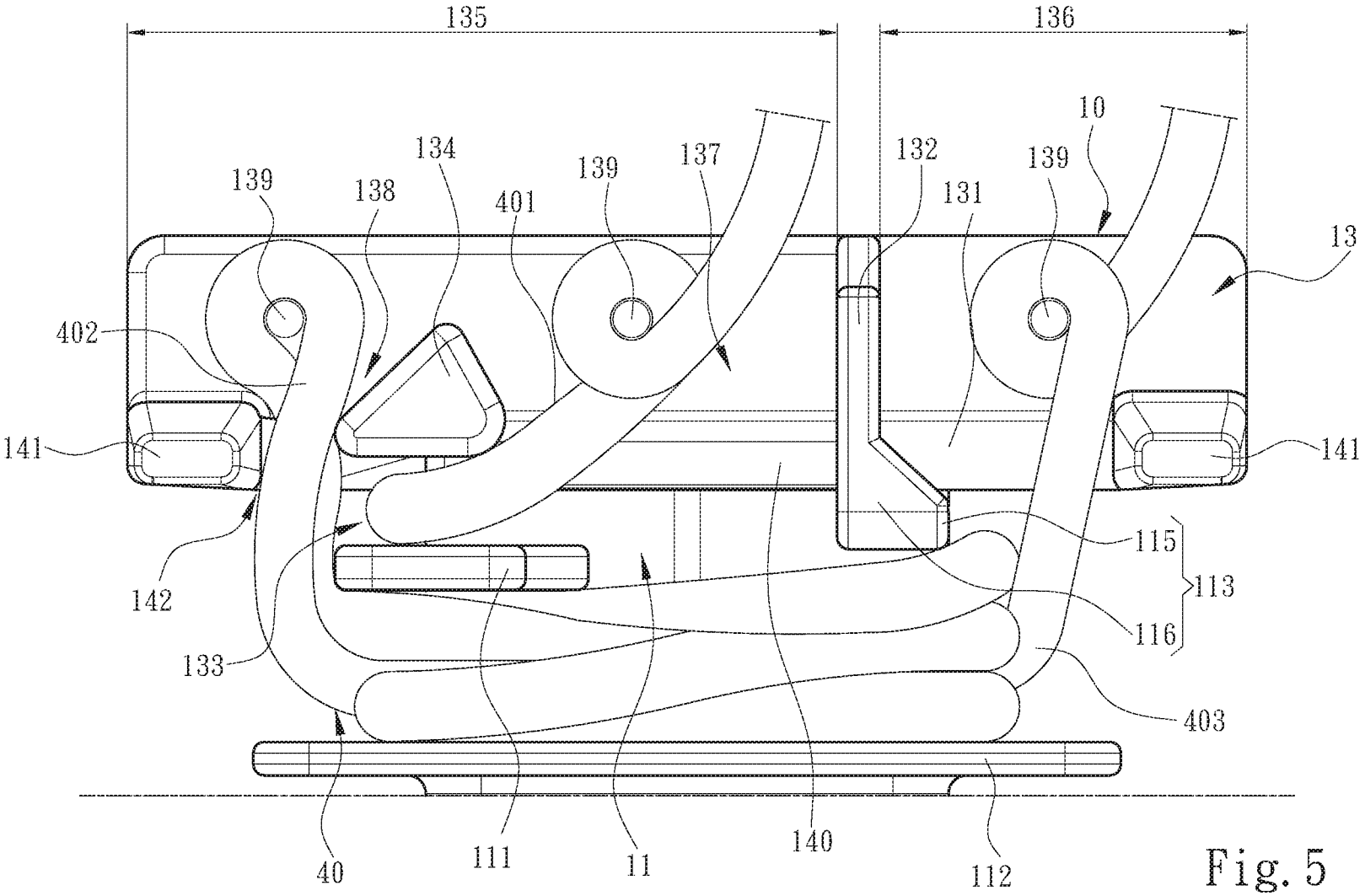
FIG. 5 is a schematic diagram of the winding of a second winding of an embodiment of the present invention.

The first winding unit 30 is arranged on the winding part 11 and a line of the first winding unit 30 penetrates through the first wire outlet part 12. On the other hand, referring to FIG. 5, the second winding unit 40 includes a first winding segment 401, a second winding segment 402, and a third winding segment 403. The first winding segment 401 enters from the initial winding area 137 and winds on the winding part 11 through the wire channel 133. The second winding segment 402 is connected with the first winding segment 401, and enters the series winding area 138. The third winding segment 403 is connected with the second winding segment 402, and a line of the third winding segment 403 penetrates into the series winding area 138 without contacting with the wire channel 133 to wind around the winding part 11 and then protrude from the second winding area 136. Further, the second winding unit 40 is implemented by a metal wire in succession, that is, the first winding segment 401, the second winding segment 402, and the third winding segment 403 are continuous segments. One end of the metal wire is wound on one of the plurality of poles 139 which is located in the initial winding area 137, and then enters the winding part 11 through the wire channel 133 to be wound on the winding part 11 in a predetermined number of turns, for example, the predetermined number of turns are two turns, which is referred to as the first winding segment 401 in the present invention. Next, the metal wire passes through one side of the first baffle 111 which is opposite the second winding area 136, and extends toward the series winding area 138 to be wound around one of the plurality of poles 139 which is located in the series winding area 138 to form the second winding segment 402. Thereafter, the metal wire further extends from the series winding area 138 toward the winding part 11, at the time the metal wire is directly extended toward the winding part 11 without contacting with the wire channel 133, and the metal wire is further wound on the winding part 11 in a desired number of turns, for example, the predetermined number of turns are two turns as referred to herein. Finally, the metal wire protrudes from the second winding area 136 to form the third winding segment 403 which is laminated over the first winding segment 401. Further, the first winding segment 401 and the second winding segment 402 form a first sub-winding unit, and the third winding segment 403 form a second sub-winding unit in series with the first sub-winding unit. The first sub-winding unit and the second sub-winding unit form the second winding unit 40 of the present invention. Accordingly, in the winding process of the second winding unit 40 of the present invention, the first winding segment 401 and the third winding segment 403 are separated by the first baffle 111 and the first block 134, so that a sleeve is not required to separate the segments which will be contacted when the second winding unit 40 is wound, that is, the winding process of the second winding unit 40 will be subtracted from a portion where the sleeve is mounted, and thus the winding of the second winding unit 40 can be carried out mechanically and automatically.

Referring to FIG. 2, FIG. 3, FIG. 4 and FIG. 5, in one embodiment, the second wire outlet part 13 includes a first wiring trough 140 provided on the first inclined surface 131 where is opposite to the initial winding area 137, and the first wiring trough 140 provides the first winding segment 401 to be wound along a surface thereof so as to avoid other segments. In addition, in one embodiment, the winding part 11 includes a second block 113 connected with the first partition plate 132, and the second block 113 includes a connection portion 114 connected to the first partition plate 132 and a nose portion 115 which extends from the connection portion 114 and protrudes toward the second winding area 136. In one embodiment, a thickness of the second block 113 is increased from the nose portion 115 toward the connection portion 114. Further, the winding part 11 includes a central axis 116, one side of the first baffle 111 facing the central axis 116 includes a first distance 117 with the central axis 116, and one side of the second block 113 facing the central axis 116 includes a second distance 118 with the central axis 116.

Figure 4:
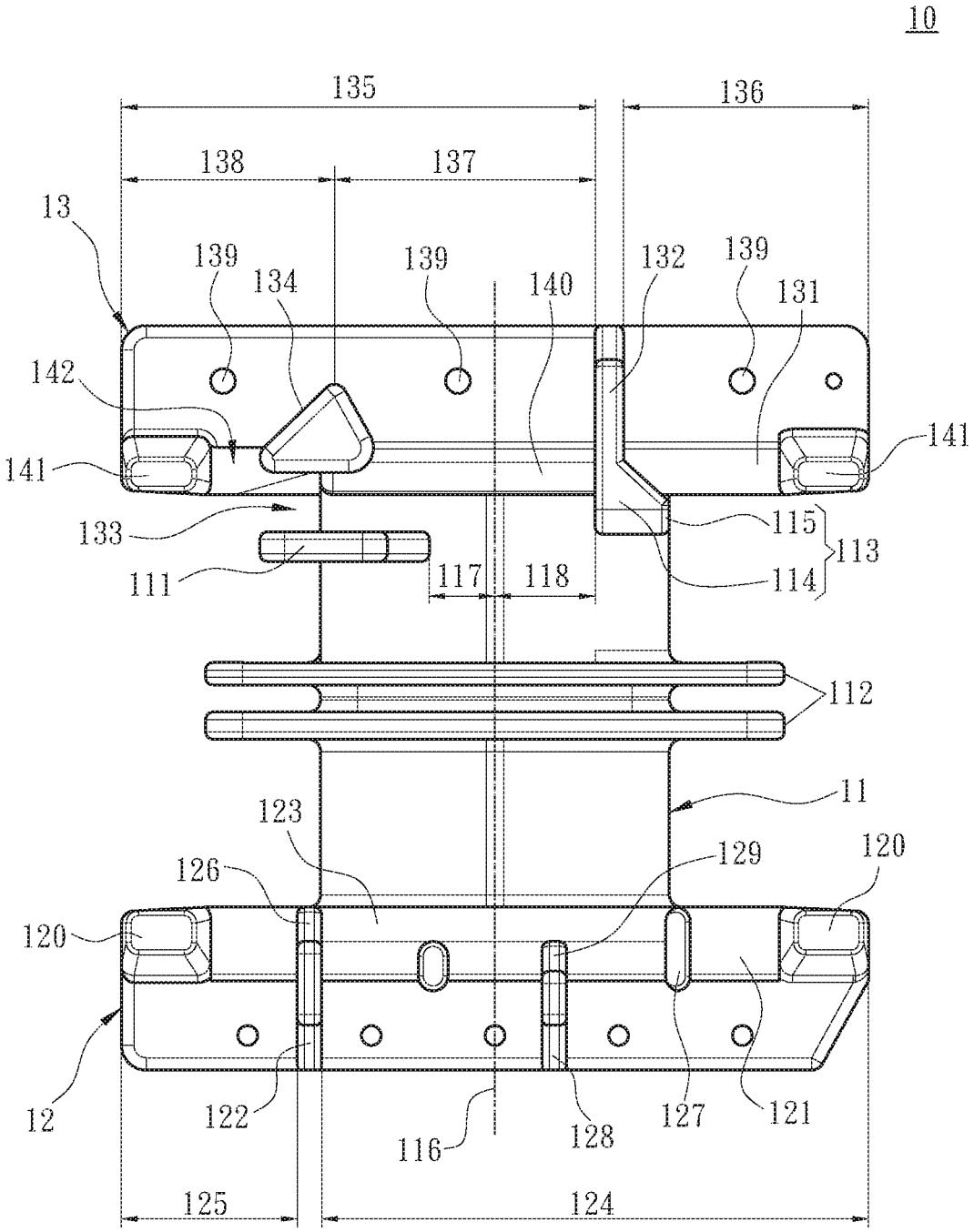
FIG. 4 is a top structural schematic diagram of a transformer wire frame of an embodiment of the present invention.

Referring to FIG. 4, in one embodiment, the second wire outlet part 13 includes two first retaining walls 141 located on two sides of the first inclined surface 131, one of the two first retaining walls 141 located within the first winding area 135 and the first block 134 together define a wire channel 142 to provide the metal wire passing through the series winding area 138. The wire channel 142 is provided to specifically limit a position of the metal wire during the winding.

Referring to FIG. 4, in addition that the second wire outlet part 13 is provided with a wire isolation structure, the first wire outlet part 12 is also designed with a wire isolation structure for winding. In one embodiment, the first wire outlet part 12 includes a second inclined surface 121 facing the winding part 11, a second partition plate 122 provided on the second inclined surface 121, and a second wiring trough 123 provided on one side of the second inclined surface 121 close to the winding part 11. Further, the second partition plate 122 divides the first wire outlet part 12 into a third winding area 124 and a fourth winding area 125, and one side of the second partition plate 122 is formed with a first wire supporting notch 126 where is facing the winding part 11. Also, the second wiring trough 123 is only located in the third winding area 124. Further, the first wire outlet part 12 includes a third partition plate 127 provided in the third winding area 124, and the third partition plate 127 and the second partition plate 122 are located at two sides of the second wiring trough 123, respectively. In addition, the first wire outlet part 12 includes a fourth partition plate 128 disposed between the second partition plate 122 and the third partition plate 127, and the fourth partition plate 128 is parallel to the second partition plate 122. One side of the fourth partition plate 128 is formed with a second wire supporting notch 129 where is facing the winding part 11 and the fourth partition plate 128 is not disposed inside the second wiring trough 123. In one embodiment, the first wire outlet part 12 includes two second retaining walls 120 on two sides of the second inclined surface 121. Accordingly, when the first winding unit 30 is wound, the step of mounting the sleeve is also eliminated, so that the transformer 100 can be automatically wound.

What is claimed is:

1. A transformer without matching sleeve for wire winding operation, comprising:

a transformer wire frame, comprising a winding part, a first wire outlet part connected with one side of the winding part, and a second wire outlet part connected with the other side of the winding part which is not provided with the first wire outlet part, wherein the winding part is provided with a first baffle close to the second wire outlet part, and the second wire outlet part is provided with a first inclined surface facing the winding part, a first partition plate arranged on the first inclined surface and a first block arranged opposite to the first baffle, and a wire channel is defined by the first block together with the first baffle, and wherein the first partition plate divides the second wire outlet part into a first winding area and a second winding area, the first baffle is only arranged corresponding to the first winding area, and the first block is located in the first winding area to divide the first winding area into an initial winding area close to the second winding area and a series winding area in an opposite direction from the second winding area;

an iron core, arranged on the transformer wire frame;

a first winding unit, arranged on the winding part and a line of the first winding unit penetrates through the first wire outlet part; and a second winding, comprising a first winding segment, a second winding segment and a third winding segment, wherein the first winding segment enters from the initial winding area and winds on the winding part through the wire channel, the second winding segment is connected with the first winding segment and enters the series winding area, and the third winding segment is connected with the second winding segment, and a line of the third winding segment penetrates into the series winding area without contacting with the wire channel to wind around the winding part, and then protrude from the second winding area.

2. The transformer without matching sleeve for wire winding operation of claim 1, wherein the second wire outlet part is provided with a first wiring trough which is arranged on the first inclined surface opposite to the initial winding area.

3. The transformer without matching sleeve for wire winding operation of claim 2, wherein the winding part comprises a second block connected with the first partition plate, and the second block comprises a connection portion connected to the first partition plate and a nose portion which extends from the connection portion and protrudes toward the second winding area.

4. The transformer without matching sleeve for wire winding operation of claim 2, wherein the second wire outlet part comprises two first retaining walls located on two sides of the first inclined surface, and one of the two first retaining walls located within the first winding area and the first block together define a wire channel passing through the series winding area.

5. The transformer without matching sleeve for wire winding operation of claim 2, wherein the second wire outlet part comprises a plurality of wire posts respectively arranged in the initial winding area, the series winding area and the second winding area.

6. The transformer without matching sleeve for wire winding operation of claim 3, wherein a thickness of the second block is increased from the nose portion toward the connection portion.

7. The transformer without matching sleeve for wire winding operation of claim 3, wherein the winding part comprises a central axis, one side of the first baffle comprises a first distance with the central axis, and one side of the second block comprises a second distance with the central axis.

8. The transformer without matching sleeve for wire winding operation of claim 3, wherein the second wire outlet part comprises two first retaining walls located on two sides of the first inclined surface, and one of the two first retaining walls located within the first winding area and the first block together define a wire channel passing through the series winding area.

9. The transformer without matching sleeve for wire winding operation of claim 3, wherein the second wire outlet part comprises a plurality of wire posts respectively arranged in the initial winding area, the series winding area and the second winding area.

* * * * *